US006491478B2

(12) United States Patent
Sager et al.

(10) Patent No.: US 6,491,478 B2
(45) Date of Patent: Dec. 10, 2002

(54) TUBULAR ANCHOR

(75) Inventors: Lutz Achim Sager, Scheuring (DE); Erich Leibhard, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/829,253

(22) Filed: Apr. 9, 2001

(65) Prior Publication Data

US 2001/0028828 A1 Oct. 11, 2001

(30) Foreign Application Priority Data

Apr. 10, 2000 (DE) ..... 100 17 751

(51) Int. Cl.[7] ..... E21D 21/00

(52) U.S. Cl. ..... 405/259.6; 405/259.5; 405/259.1

(58) Field of Search ..... 405/259.1, 259.5, 405/259.6; 175/403

(56) References Cited

U.S. PATENT DOCUMENTS 4,055,051 A * 10/1977 Finney ..... 175/226
5,374,140 A * 12/1994 Standish et al. ..... 405/248
5,823,275 A * 10/1998 Ku et al. ..... 125/20
5,980,168 A * 11/1999 Tsypin et al. ..... 175/20
6,368,021 B1 * 4/2002 Strong et al. ..... 175/171

* cited by examiner

*Primary Examiner*—Heather Shackelford
*Assistant Examiner*—Lisa M. Saldano
(74) *Attorney, Agent, or Firm*—Sidley Austin Brown & Wood, LLP

(57) ABSTRACT

A tubular anchor including a tubular member (1) having, at its one end, a crown-shaped drilling head (2) and, at its opposite end, a load application element a substantially cylindrical hollow element (7) filled with a mortar mass (4), located inside the tubular member (1), and having, at its end facing in the direction opposite to the setting direction, an opening (11) enabling flow of the mortar mass therethrough, and at least one longitudinal channel (12) communicating the opening (11) with an outlet opening (5) provided in the region of the drilling head (2).

6 Claims, 2 Drawing Sheets

TUBULAR ANCHOR

BACKGROUND OF THE INVENTION

1. Field of the Invention

The present invention relates to a fastening element such as, e.g., a roof bolt, used primarily in mine and/or tunnel constructions and including a tubular member having, at one of its end facing in a setting direction, a drilling head and at its opposite end facing in a direction opposite to the setting direction, load application means, and having, in a region of the drilling head, at least one outlet opening connecting the longitudinal bore of the tubular member with an outer surface of the body.

2. Description of the Prior Art

Fastening elements of the type described above are generally known. They function primarily for stabilizing walls of hollow spaces such tunnels, galleries and the like. They are used primarily for securing to each other following each other, in a direction transverse to the wall, the wall-forming strata. In many cases, the mechanical characteristics of the layers, which lie in immediate vicinity of the wall surface, in particular, their supporting resistance, changes as a result of formation of a hollow space. Therefore, these layers need be secured to further located, undamaged or unaffected layers or strata.

A fastening element or a roof bolt of the above-described type is disclosed, e.g., in U.S. Pat. No. 4,055,051. The U.S. Patent discloses a roof bolt that is formed of a tubular element provided, at one of its end, with a drilling head and, at its other opposite end, with load application means. The interior of the disclosed roof bolt is partially filled with mortar mass. An exit channel extends through the drilling head. The setting process of the disclosed roof bolt is effected in two steps. In the first step, the roof bolt forms, with the use of an available drilling tool, a bore in the constructional component, in particular, in the ground. The drilled-of and comminuted stone, which is produced upon drilling with the drilling head of the roof bolt, is removed through outlet openings provided in the drilling head and the space between the bore wall and the outer surface of the fastening element. In a second step, a piston, which is provided at an end of the roof bolt facing in the direction opposite to the setting direction, is advanced in the setting direction, pressing out the mortar mass, which fills the interior of the roof bolt, through the openings provided in the drilling head.

One of the drawbacks of the roof bolt disclosed in U.S. Pat. No. 4,055,051 consists in that the setting process has two steps and, therefore, requires use of a special setting tool. The two-step setting process also substantially increases the setting cycle duration.

Moreover, during the drilling step, the amount of the removed and committed material, stone and the like, corresponds to the entire cross-section of the insertable tubular anchor, which adversely affects the output and increases the operational time of the drilling step.

An object of the present invention is to provide a tubular anchor that can be set in a single step with the use of a conventional drilling tool.

SUMMARY OF THE INVENTION

This and other objects of the present invention, which will become apparent hereinafter, are achieved by providing in the tubular member substantially cylindrical hollow means filled with a mortar mass, with the cylindrical hollow means having, at its end facing in the direction opposite to the setting direction, an opening enabling flow of the mortar mass therethrough and having an inner diameter corresponding at least to an inner diameter of the drilling head which is formed as a crown bit, and by providing at least one longitudinal channel communicating the flow-enabling opening with the outlet opening provided in the region of the drilling head.

By forming the drilling head as a crown bit, the inner diameter of which at most corresponds to the inner diameter of the mortar mass receiving means, which is formed as a hollow cylinder, the drill core, which is formed during the drilling process can be received in the mortar mass receiving means. The drill core, when extending into the interior of the mortar mass receiving means, applies a pressure to mortar mass. This pressure is used for opening the mortar mass flow-enabling opening formed in the mortar mass receiving means. When the pressure applied to the mortar mass becomes sufficiently high, the flow-enabling opening opens, and the mortar mass can flow into the channel leading to the outlet opening in the region of the drilling head. Due to the rotational movement of the tubular anchor and, in particular of the drilling head, the mortar mass intermixes with the drillings in the region of the outlet opening and is squeezed into a space between the wall of the bore formed in the construction component and the outer circumferential surface of the tubular anchor. Further, separate mortar mass-receiving means permits to store the tubular members separately from the mortar mass which has limited storing properties.

Because the mortar mass is squeezed out by the drill core, the tubular anchor according to the present invention can be set with a conventional drilling tool and does not require the use of any auxiliary means or operational steps in order to be completely set.

Advantageously, the cylindrical hollow means includes two pistons for closing its opposite ends respectively, and a receiving space provided adjacent to the piston, which closes an end of the cylindrical hollow means facing in the direction opposite to the setting direction, for receiving this piston. The mortar mass flow-enabling opening is formed in a wall portion of the cylindrical hollow means defining the piston-receiving space and is spaced from a free end of the piston-receiving space by a distance which corresponds at least to a length of the piston measured in a longitudinal direction of the tubular member. The mortar mass, which is located between the two displaceable pistons, is displaced by the drill core in the direction opposite to the setting direction. With the displaceable mortar mass, the piston, which is located at the end of the mortar mass-receiving means remote from the drilling head, is also displaced into the piston-receiving space, which is formed in the mortar mass-receiving means, until it completely frees the flow-enabling opening. The use of this sealing piston insures that, with a sufficiently high pressure acting on the piston, the flow-enabling opening can be open under any conditions. It is to be also noted that this embodiment of the tubular anchor can be economically produced as a need in the use and, thereby, in manufacture and assembly of a complicated mechanism for freeing the opening is eliminated.

Advantageously, the outer diameter of the drilling head is larger than the largest diameter of the tubular member. This insures free-cutting of an annular slot in which the mortar mass, which is intermixed with drillings, is received.

Preferably, the outer diameter of the mortar mass-receiving means is smaller than the inner diameter of the tubular member, which insures an easy insertion of the receiving means in the tubular member.

Advantageously, the channel leading to the outlet opening, which is located in the region of the drilling head, is formed by a slot extending between the inner wall of the tubular member and the outer surface of the mortar mass-receiving means. During the manufacturer of the tubular member by, e.g., rolling a metal sheet, the slot can be formed in the inner wall of the tubular member by a separate operational step. The process of forming the tubular member is very cost-effective.

Advantageously, the channel is formed as a helically extending slot so that conventional rolling process for producing the tubular member can be used.

Advantageously, at least one hose-like bag is provided in the mortar mass-receiving means for storing the mortar mass therein to facilitate handling of the mortar mass and of the inventive tubular anchor.

The novel features of the present invention, which are considered as characteristic for the invention, are set forth in the appended claims. The invention itself, however, both as to its construction its mode of operation, together with additional advantages and objects thereof, with be best understood from the following detailed description of preferred embodiments, when read with reference to the accompanying drawings.

DETAILED DESCRIPTION OF THE PREFERRED EMBODIMENT

Figure 1:
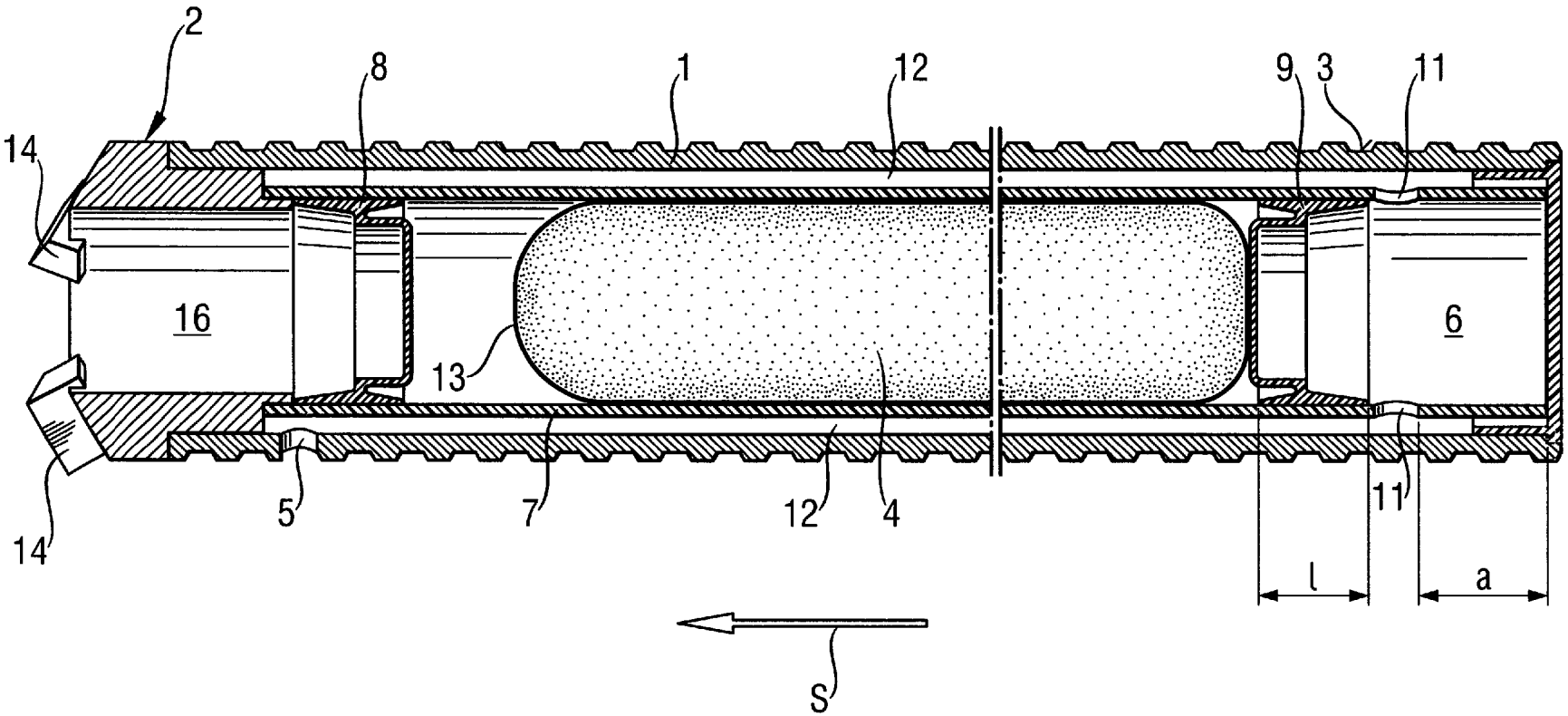
FIG. 1 a longitudinal cross-section view of a tubular anchor according to the present invention.
Figure 2:
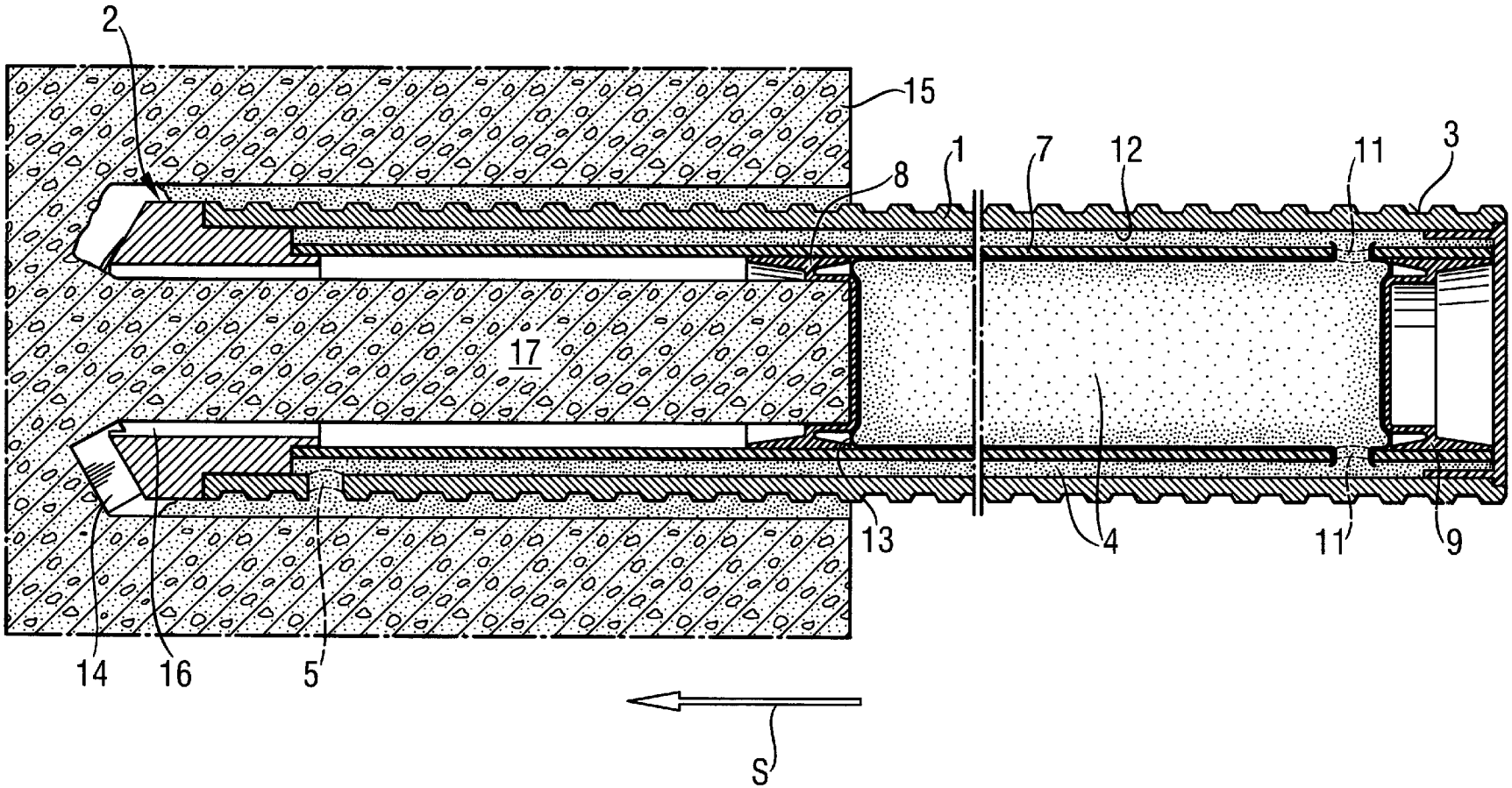
FIG. 2 a longitudinal cross-section view of the sectional view of the anchor shown in FIG. 1 during the setting process.

A tubular anchor according to the present invention, which is shown in FIGS. 1–2, has a cylindrical tubular member inside of which means 7 for receiving a mortar mass 4 is located. At its end facing in the setting direction S, the tubular member 1 is provided with a crown-shaped drilling head 2. At its opposite end, the tubular member is provided with load application means 3 which is formed as a shaped profile.

The tubular member 1, which is formed, e.g., of metal, has at its end facing in the setting direction S, one or more outlet openings 5. The load application means-forming shaped profile extend over the entire length of the tubular member. The shaped profile can be produced, e.g., by rolling.

The crown-shaped drilling head 2 has a conical tip and a central bore 16. The drilling head 2 is inserted in the tubular member 1. The tip conical surface is provided with abrasive elements 14, in particular, hard metal elements. To provide for removal of the drilling dust and/or drillings, the outer diameter of the drilling head 2 is made greater than the diameter of the tubular member 1. The inner diameter of the drilling head 2 is smaller than the inner diameter of the tubular member 1 and is smaller or, at most, equal to the inner diameter of the mortar mass-receiving means 7.

The mortar mass-receiving means 7, which is formed as a cylindrical hollow member, can be formed, e.g., of a plastic material. The receiving means 7 is closed, at its opposite ends, with respective pistons 8, 9 displaceable along the tubular member 1. A piston-receiving region 6 having an opening 11 adjoins the piston 9 which is provided at the end of the receiving means 7 facing in the direction opposite to the setting direction. The region 6 is designed for receiving the piston 9. The opening 11 is spaced from the free end of the piston-receiving region 6 by a distance (a) which corresponds at least to the length (1) of the piston 9 measured in the longitudinal direction of the tubular member 1. The mortar mass 4 can be packed, e.g., in a hose-shaped bag 13.

During the setting process shown, in particular in FIG. 2, the tubular anchor is subjected, e.g., by a drilling tool (not shown), to rotational and translateral movements. The crown-shaped drilling head 2 forms a circular slot in the constructional component 15 for receiving the tubular member 1, with a core 17 remaining in a central bore 16 of the drilling head 2. The core 17, which is loosely located in the bore 16, applies, to the piston 8, which is located at the end of the tubular member (1) facing in the setting directions, a pressure acting in the direction opposite to the setting direction. The mortar mass 4, which fills the mortar mass-receiving means 7, transmits the pressure, which is applied by the core 17, to the second piston 9 located at the end of the tubular member 1 facing in the direction opposite to the setting directions S. The second piston 9 is displaced, in the direction opposite to the setting direction, until it is completely located in the piston-receiving region 6, releasing thereby the through-opening 11. With the pressure still being applied to the mortar mass 4 by the core 17, the mortar mass 4 is squeezed through the through-opening 11 into the channel 12 and flows therethrough to the openings 5 in a manner shown in FIG. 2. At the openings 5, the mortar mass 4 is intermixed, as a result of rotation of the tubular member 1 and, in particular, of the drilling head 2, with drillings. The mortar mass, which is intermixed with the drillings, under pressure, is uniformly distributed in the space between the wall of the slot formed in the constructional component 15 and the outer surface of the tubular member 1.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. By A tubular anchor, comprising a tubular member (1) having, at one end thereof facing in a setting direction, a crown-shaped drilling head (2) and at opposite end thereof facing in a direction opposite to the setting direction, load application means, and having, in a region of the drilling head (2), at least one outlet opening (5); substantially cylindrical hollow means (7) filled with a mortar mass (4) and located inside the tubular member (1), the cylindrical hollow means (7) having, at an end thereof facing in the direction opposite of the setting direction, an opening (11) enabling flow of the mortar mass therethrough and having an inner diameter corresponding at least to an inner diameter of the crown-shaped drilling head (2); and at least one longitudinal channel (12) communicating the opening (11) provided in the cylindrical hollow means (7) with the outlet opening (5), wherein the cylindrical hollow means (7) includes, a first and second piston (8, 9) for closing opposite ends thereof, respectively, and a receiving space (6) provided adjacent to the second piston (9), wherein the receiving space closes an end of the cylindrical hollow means (7) facing in the direction opposite to the setting direction, for receiving the second piston (9), and wherein the mortar mass flow-enabling opening (11) is formed in a wall portion of the cylindrical hollow means (7) defining the piston-receiving space (6) and is spaced from a free end of the piston-receiving space (6) by a distance (a) which corresponds at least to a length (1) of the second piston (9) measured in a longitudinal direction of the tubular member (1).

2. A tubular anchor according to claim 1, wherein the drilling head (2) has an outer diameter that is greater than a largest diameter of the tubular member (1).

3. A tubular anchor according to claim 1, wherein the cylindrical hollow means (7) has an outer diameter smaller than an inner diameter of the tubular member (1).

4. A tubular anchor according to claim 3, wherein a slot, which is formed between an outer surface of the cylindrical hollow means (7) and an inner surface of the tubular member (1) forms the longitudinal channel (12).

5. A tubular anchor, comprising a tubular member (1) having, at one end thereof facing in a setting direction, a crown-shaped drilling head (2) and at opposite end thereof facing in a direction opposite to the setting direction, load application means, and having, in a region of the drilling head (2), at least one outlet opening (5); substantially cylindrical hollow means (7) filled with a mortar mass (4) and located inside the tubular member (1), the cylindrical hollow means (7) having, at an end thereof facing in the direction opposite of the setting direction, an opening (11) enabling flow of the mortar mass therethrough and having an inner diameter corresponding at least to an inner diameter of the crown-shaped drilling head (2); and at least one longitudinal channel (12) communicating the opening (11) provided in the cylindrical hollow means (7) with the outlet opening (5), wherein the cylindrical hollow means (7) has an outer diameter smaller than an inner diameter of the tubular member (1), wherein a slot, which is formed between an outer surface of the cylindrical hollow means (7) and an inner surface of the tubular member (1) forms the longitudinal channel (12), and wherein the slot is formed as a helical slot.

6. A tubular anchor, comprising a tubular member (1) having, at one end thereof facing in a setting direction, a crown-shaped drilling head (2) and at opposite end thereof facing in a direction opposite to the setting direction, load application means, and having, in a region of the drilling head (2), at least one outlet opening (5); substantially cylindrical hollow means (7) filled with a mortar mass (4) and located inside the tubular member (1), the cylindrical hollow means (7) having, at an end thereof facing in the direction opposite of the setting direction, an opening (11) enabling flow of the mortar mass therethrough and having an inner diameter corresponding at least to an inner diameter of the crown-shaped drilling head (2); and at least one longitudinal channel (12) communicating the opening (11) provided in the cylindrical hollow means (7) with the outlet opening (5), wherein the cylindrical hollow means (7) includes a hose-shaped bag (13) for storing the mortar mass (4) and located inside the cylindrical hollow means (7).

* * * * *